US008857053B2

(12) United States Patent
Moss et al.

(10) Patent No.: US 8,857,053 B2
(45) Date of Patent: Oct. 14, 2014

(54) COMPRESSOR HOUSING REMANUFACTURING METHOD AND APPARATUS

(75) Inventors: Jarrod David Moss, Washington, IL (US); Douglas L. Hampton, Lewistown, IL (US); Trent A. Simpson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 2054 days.

(21) Appl. No.: 11/847,103

(22) Filed: Aug. 29, 2007

(65) Prior Publication Data

US 2009/0060727 A1 Mar. 5, 2009

(51) Int. Cl.

| | |
|---|---|
| ***B23P 15/00*** | (2006.01) |
| ***F04D 29/62*** | (2006.01) |
| ***F04D 29/42*** | (2006.01) |
| ***F01D 1/06*** | (2006.01) |

(52) U.S. Cl.

CPC ..... *F01D 1/06* (2013.01); *F04D 29/624* (2013.01); *F04D 29/4206* (2013.01)

USPC ..... 29/888.021; 29/402.08; 29/402.11; 29/402.04

(58) Field of Classification Search

USPC ..... 29/888.021, 888.02, 897.1, 889.1, 29/889.2, 402.01, 402.02, 402.03, 402.06, 29/402.07, 402.08, 402.11, 402.09, 29/402.13, 402.16, 402.18

See application file for complete search history.

(56) References Cited

U.S. PATENT DOCUMENTS

| | | | | |
|---|---|---|---|---|
| 3,781,126 | A * | 12/1973 | Benisek | 415/143 |
| 3,866,423 | A | 2/1975 | Benisek | |
| 4,440,137 | A | 4/1984 | Lagano et al. | |
| 4,513,727 | A | 4/1985 | Lagano et al. | |
| 4,691,423 | A * | 9/1987 | Willyard et al. | 29/888.025 |
| 5,295,300 | A | 3/1994 | Garrick, Jr. | |
| 5,799,394 | A * | 9/1998 | Rice | 29/889.22 |

* cited by examiner

*Primary Examiner* — Christopher Besler

(74) *Attorney, Agent, or Firm* — Leydig, Voit & Mayer, Ltd.

(57) ABSTRACT

A compressor housing defines an inlet bore having a first inlet collar disposed therein. The inlet collar is connected to the housing with a first plurality of radially extending posts. The first plurality of posts is removed to detach the inlet collar from the housing, and the inlet collar is removed from the housing. The same or another inlet collar is concentrically located within a liner. The liner can be located at a radial distance around at least a portion of the inlet collar. The inlet collar is connected to the liner by radially inserting a second plurality of posts through the liner and into the inlet collar. An assembly of the liner containing the inlet collar is inserted into the inlet bore of the housing such that the inlet collar forms the inducer bore of the compressor housing.

20 Claims, 5 Drawing Sheets

- PRIOR ART -

- PRIOR ART -

COMPRESSOR HOUSING REMANUFACTURING METHOD AND APPARATUS

TECHNICAL FIELD

This patent disclosure relates generally to turbochargers for internal combustion engines, and more particularly to methods for reworking or remanufacturing turbocharger housings.

BACKGROUND

Turbochargers for use with internal combustion engines are known. A typical turbocharger includes a turbine that is connected to a compressor through a center-housing. During operation, exhaust gas from the engine passes through the turbine and causes a turbine wheel to rotate. The rotating turbine wheel is connected to an end of a shaft that extends through the center-housing into the compressor. A compressor wheel connected to an opposite end of the shaft rotates and, thus, operates to compress air entering the engine. Operation and efficiency of the compressor, in general terms, are limited by the size of the compressor, as well as by the diameter of an inlet opening to the compressor, which is also known as an inducer opening or diameter. Under certain operating conditions, for example, when the compressor operates close to a surge condition, it is possible to improve the efficiency of the compressor by introducing a recirculation passage.

In a typical compressor, the recirculation passage is an annular volume or cavity that surrounds the inducer opening. The recirculation volume is open on both ends to an inlet bore of the compressor, and serves to recirculate at least some air from a region around the trailing edges of the compressor wheel blades, to a region upstream of the compressor wheel but still within the inlet bore of the compressor. The recirculation passage can be defined between an inner surface of the inlet bore of the compressor, and an outer surface of an inlet collar, the inlet collar defining internally the inducer bore. The inlet collar is typically cast unitarily with the compressor housing, and is connected to the housing by a plurality of posts.

It has been found that placement of the posts within the recirculation volume can, under certain operating conditions, affect the performance of the turbocharger. For instance, it has been found that a symmetrical orientation of three posts within the recirculation volume generates regions of fluctuating pressure in areas adjacent to the trailing edges of the compressor wheel blades. These pressure fluctuations can expose the compressor wheel blades to fluctuating stresses that, under resonance conditions, have been known to cause cracks and even structural failures in the tips of compressor wheel blades. Moreover, the fluctuating pressures in the recirculation passage can cause unwanted audible noise.

It has been found that asymmetrical placement of the posts within the recirculation passage can resolve issues caused by the resonance of fluctuating pressures. It is believed that the asymmetrical placement of the posts can disrupt standing waves that cause the pressure fluctuations and avoid the creation of fluctuating stresses to the compressor wheel blades, as well as reduce or eliminate the noise that is created. Hence, newer designs for compressor housings having asymmetrical post arrangements have been used on new turbochargers.

Compressor housings are typically formed in a casting operation, and finished with a series of machining operations. The machining operations form the various features of the compressor housing, and can include operations that grind and/or cut the various features out of a "raw" casting. While these machining operations are being performed, special care is taken when forming surfaces or features of the compressor housing that will interact with other components. For example, when forming a portion of the inducer diameter in an inlet collar of the compressor, care is taken to maintain a proper diameter opening and proper position of the inducer diameter because of its proximity to the rotating blades of the compressor wheel when the compressor is fully assembled. Formation of the inducer opening is often accomplished by setting the compressor housing into a fixture that locates the position of the inducer opening with respect to machining targets or datum targets that are formed in the casting as reference points or areas.

When a used turbocharger unit having a symmetrical inlet post configuration (e.g., a three-post symmetrical configuration) is returned to a re-manufacturer for rebuilding, reconditioning, or updating, the used compressor housing having the symmetrical post configuration may be replaced with a new compressor housing having a non-symmetrical inlet post configuration (e.g., a four-post non-symmetrical configuration). Even though replacement of compressor housings on returned turbocharger units is a costly operation, it has been the only option for remanufacturers wanting to update these old turbocharger units because of the lack of alternative viable methods for rebuilding a compressor housing while maintaining the strict positional and dimensional tolerances that are required for proper operation of the resultant remanufactured turbocharger.

BRIEF SUMMARY OF THE INVENTION

A compressor housing defines an inlet bore having a first inlet collar disposed therein. The inlet collar is connected to the housing with a first plurality of radially extending posts. The first plurality of posts is removed to detach the inlet collar from the housing before the inlet collar is removed from the housing. The same or another inlet collar is then concentrically located within a liner. The liner can be located at a radial distance around at least a portion of the inlet collar. The inlet collar is connected to the liner by radially inserting a second plurality of posts through the liner and into the inlet collar. The liner containing the inlet collar is then inserted into the inlet bore of the housing such that the inlet collar forms the inducer bore of the compressor housing.

Thus, a remanufactured compressor housing for a turbocharger may include an inlet bore that extends along a centerline, between an edge of the housing and a first recirculation slot annular surface. The cylindrical liner is disposed in the inlet bore and defines a plurality of radially extending openings. The inlet collar, which is concentrically disposed in the cylindrical liner, may form a plurality of radially extending holes. Each of the plurality of radially extending holes is advantageously aligned with a respective radial opening in the cylindrical liner such that the plurality of posts can be radially disposed through the cylindrical liner and into a respective radially extending hole of the inlet collar. The plurality of posts operates to retain the inlet collar within the cylindrical liner. A second recirculation slot annular surface defined on the collar can be located at an axial distance from the first recirculation slot annular surface to form a re-circulation slot after the liner and collar assembly have been inserted into the inlet bore.

In the exemplary embodiment, a method of reworking a compressor-housing is presented. The housing has a first plurality of posts arranged in a symmetrical configuration around an inlet collar that is located within the inlet bore. The method of reworking includes performing a first cutting operation that severs the first plurality of posts connecting the inlet collar with the housing of the compressor. Thus, support is removed between the housing and the inlet collar to enable removal of the inlet collar from the housing. A second cut that extends peripherally around an inner portion of the inlet bore and that removes a cylindrical layer of material is performed on the housing. The second cut operates to form a cylindrical cavity around the inlet bore. In a separate operation, the inlet collar is concentrically positioned within a liner to yield an inlet assembly. To accomplish this, the inlet collar is first cleaned from any debris left over from the first cutting operation, and is then positioned concentrically within the liner. A plurality of openings that extend radially through the liner and into the inlet collar are formed, and a second plurality of posts are inserted, one each, through each of the plurality of openings. The second plurality of posts are arranged in a non-symmetrical configuration around the inlet collar. Finally, the inlet assembly is inserted into the cylindrical cavity of the inlet bore.

DETAILED DESCRIPTION

This disclosure relates to a method of remanufacturing turbochargers during a rebuilding, retrofitting, or reconditioning process. The process for remanufacturing turbochargers disclosed herein advantageously includes a procedure for converting an inlet port geometry for a compressor housing having an old or obsolete design to a new or different design. The disclosed remanufacturing process includes a series of operations that can result in a compressor housing that incorporates modifications to a compressor housing of a previous design into a new design and can be, thus, more cost effective than a remanufacturing process that involves scrapping the old compressor housing and replacing it with a new one.

Figure 1:
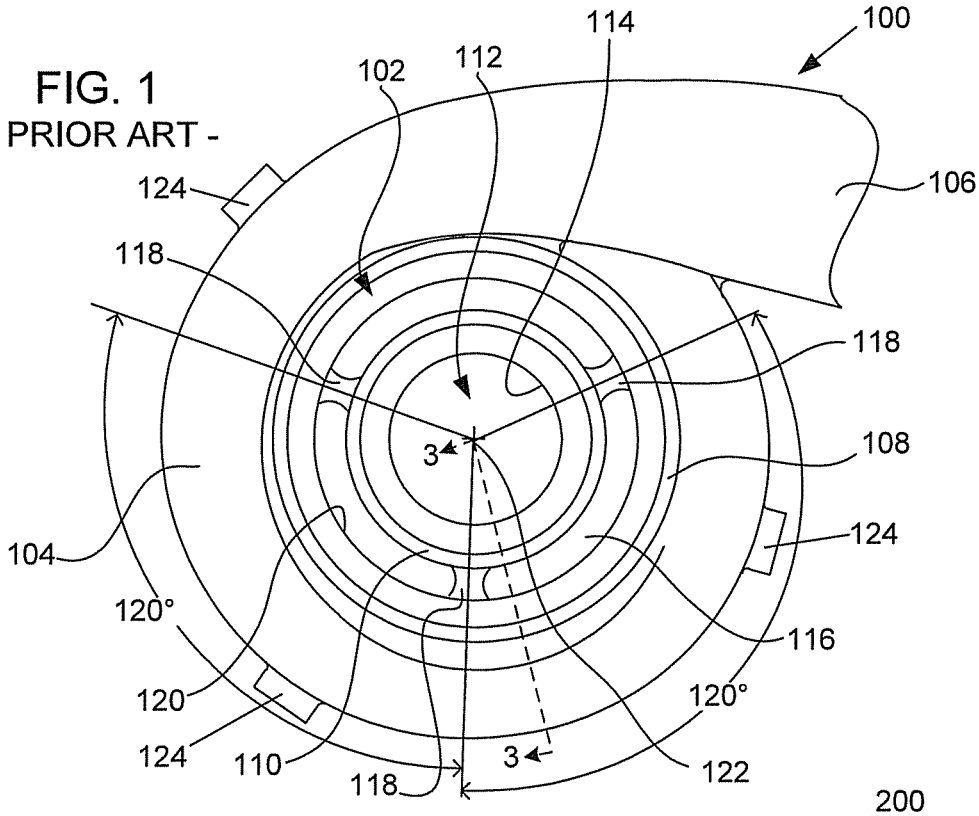
FIG. 1 is an outline view of a compressor housing having a symmetrical arrangement of posts connecting an inlet collar to the housing.

More specifically, a compressor housing 100 having an inlet bore 102 is shown in FIG. 1. The housing 100, which may be unitarily formed by a casting process, includes a scroll or volute portion 104, an outlet 106, and an inlet interface 108. The inlet interface 108 presented in FIG. 1 is configured for connecting the compressor housing 100 to an air inlet duct (not shown) by use of a clamp (not shown). This configuration is typical for connections of compressor inlets to other components of a machine, but other configurations are also known.

An inlet collar 110 surrounds an air inlet port 112. An inner diameter 114 of the inlet collar 110, which is also known as an inducer diameter, is the opening through which air enters the compressor housing 100 during operation. A recirculation slot 302 (shown in FIG. 3) fluidly connects the inlet port 112 with a recirculation passage 116. The recirculation passage 116 is open to the inlet bore 102 at a location upstream of the collar 110 such that air can recirculate through the passage 116 during operation of the compressor as is known.

The collar 110 is suspended within the inlet bore 102 of the housing 100 by a plurality of unitarily formed posts 118 that connect the collar 110 with an inner portion 120 of the inlet bore 102 along a radial direction with respect to the circular inlet bore 102. In the illustration of FIG. 1, three posts 118 are defined around the collar 110. Other configurations of compressors having a different number of posts, as well as different symmetrical arrangements for those posts, are known. The three posts 118 are arranged in a symmetrical pattern around a centerline 122 of the inlet bore 102, with 120-degrees of separation between each two adjacent posts 118. It has been found that the symmetrical placement of the posts 118 around the inlet port 112 may cause unwanted noise and/or fatigue to the blades of the compressor wheel (not shown) during operation.

Figure 2:
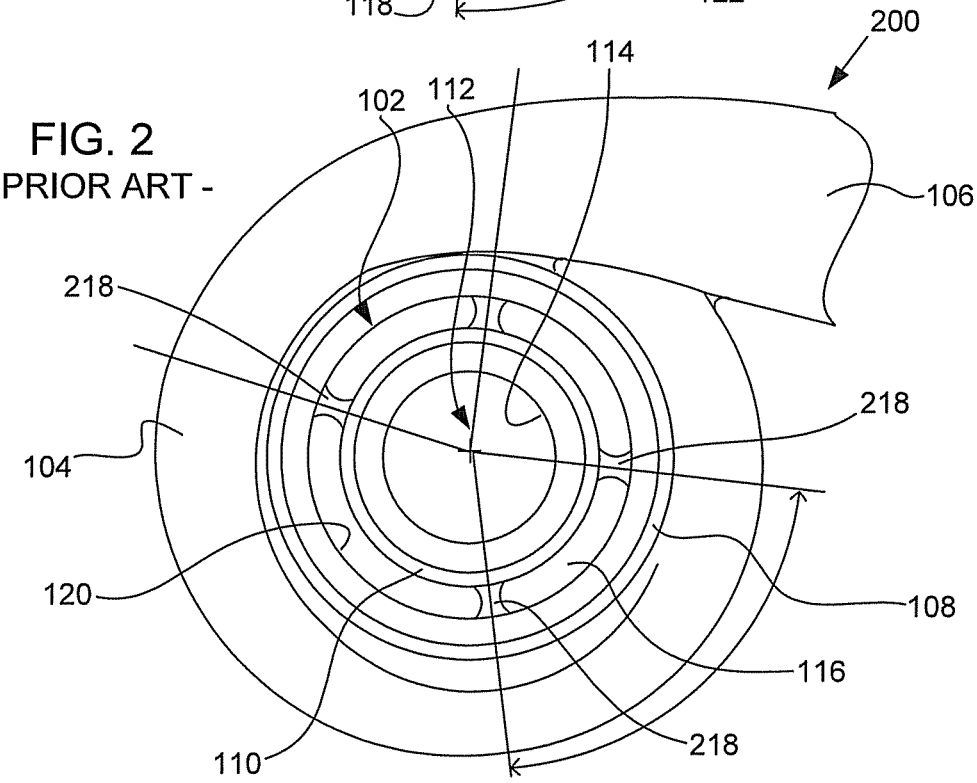
FIG. 2 is an outline view of a compressor housing having a non-symmetrical arrangement of posts between the inlet collar and the housing.

An outline view of a compressor housing 200 having a new or improved post configuration is shown in FIG. 2. Like features of the compressor-housing 200 are denoted with the same reference numerals as used in the description of the compressor housing 100, presented in FIG. 1. The housing 200 has an arrangement of four posts 218 arranged around the inlet collar 110. As can be seen, the four posts 218 are arranged in a non-symmetrical fashion around the collar 110 such that undesired resonance effects are reduced or eliminated. As mentioned above, both the posts 118 of the housing 100 as well as the posts 218 of the housing 200 are unitarily formed during a casting operation that forms the respective housing 100 or 200. Hence, one wanting to update a turbocharger having a compressor housing 100 connected thereto to a newer design having a different post arrangement would ordinarily have to replace the entire housing 100, for example, with the housing 200, and scrap the housing 100. The cost associated with this replacement can advantageously be avoided as described below.

Figure 3:
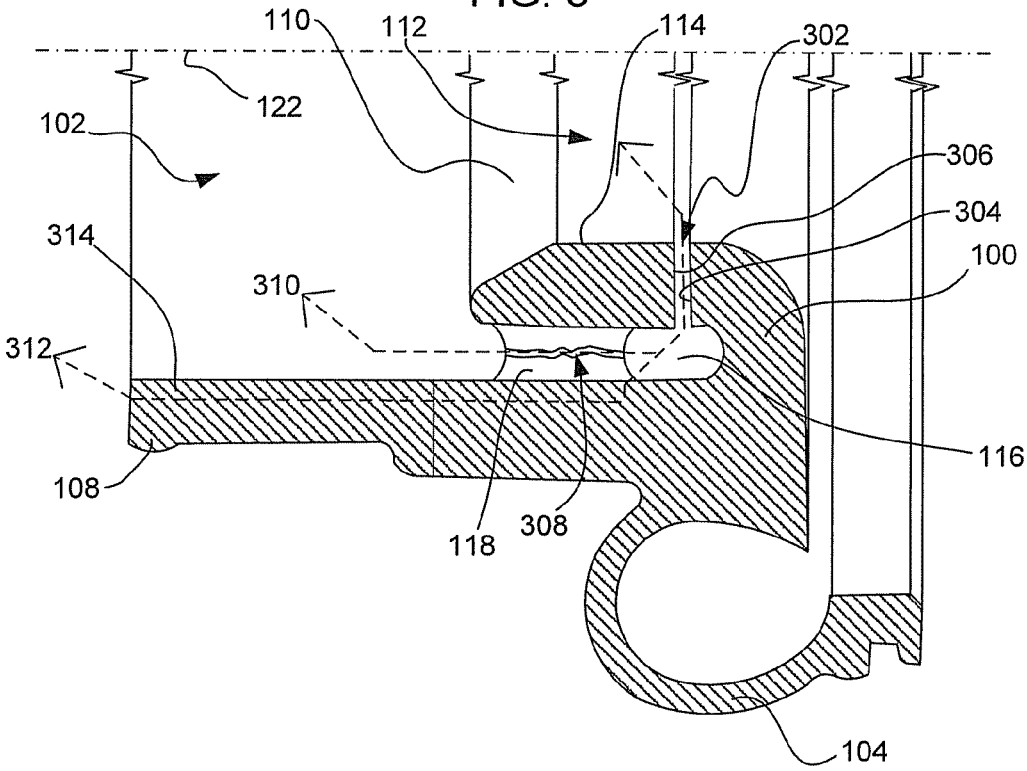
FIG. 3 is a cross-section view of the compressor shown in FIG. 1, showing the location of cuts to be performed in accordance with the disclosure.

A partial cross-section of the housing 100 is shown in FIG. 3. In this figure, like reference numerals denote like features for the sake of simplicity. Here, the recirculation slot 302 described above is visible. The recirculation slot 302 fluidly connects the inlet port 112 with the recirculation slot 116. The slot 302 is formed between a first recirculation slot annular surface 304 and a second recirculation slot annular surface 306. The first recirculation slot annular surface 304 is defined on the housing 100, and the second recirculation slot annular surface 306 is defined on an inner side of the collar 110.

During a reworking process of the housing 100, a first cut 308 is performed along line 310, shown in dashed lines, to sever the connecting posts 118 that form the connection between the collar 110 and the housing 100 at a first axial location along the centerline 122. The cut 308 acts to cut or otherwise remove support between the housing and the collar 110 through each of the posts 118. The cut 308 can be performed through a variety of techniques, for example, drilling, plunge-cutting, milling, or turning the housing 100 on a lathe. After cutting each of the posts 118, the collar 110 detaches from the housing 100 such that it can be removed from the housing 100. After the collar 110 has been removed from the housing 100, all positional relationships and tolerances associated with the inner portion of the collar 110 are lost.

Following removal of the collar 110 from the housing 100, a second cut 312 can be performed that removes any remaining structure of the posts 118 from the inlet bore 102 of the housing. The second cut 312 is optional and is represented by a dashed-line with arrows. In the embodiment shown, the second cut 312 may extend peripherally around an inner portion of the inlet bore 102 to remove a cylindrical layer of material 314 from the housing 100. In the case when the housing 100 is, for example, turned on a lathe to remove the posts 118, the second cut 312 may be combined with the first cut 308 in a single cutting operation.

The position and dimensions of the second cut 312 can advantageously be configured in accordance with the dimensional and positional configuration used when the compressor housing 100 was first manufactured. Specifically, the second cut 312 can be arranged for accurate positioning with respect to concentricity with the original position of interior portion of the inlet collar 110. For example, a plurality of datum targets 124 that are formed on the housing 100, as shown in FIG. 1, may be used to clamp and constrain the housing 100 into a machine that originally forms the inducer diameter 114. A positional relationship between the datum targets 124 and the inducer diameter 114 in the original compressor housing 100 ensures a proper fit and operation for the housing 100 when the housing 100 is first manufactured. In a similar fashion, the second cut 312 can be performed with the housing 100 clamped into another machine that uses the same datum targets 124 to locate a cutter (not shown) in a precise positional relationship with respect to the datum targets 124, and thus, in a precise relationship to the inlet collar 110 in its original location.

Figure 4:
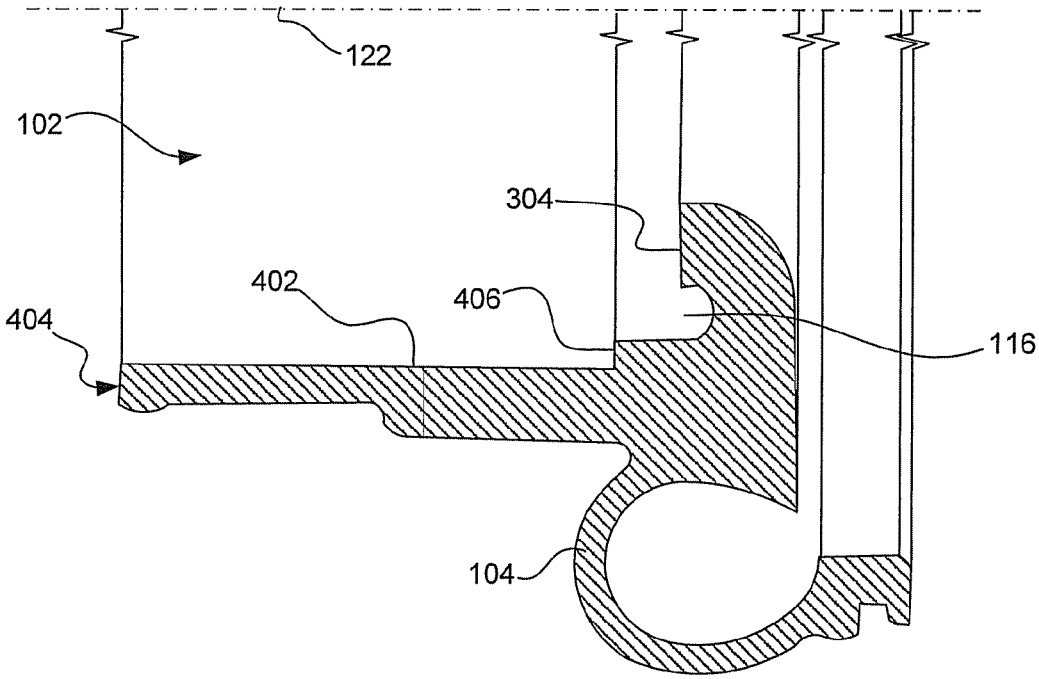
FIG. 4 is a cross-section view of the compressor shown in FIG. 4 after modifications are complete in accordance with the disclosure.

A partial cross-section view of the housing 100 after the first cut 308 and the optional second cut 312 have been performed is shown in FIG. 4. The housing in this stage of the remanufacturing process has the first recirculation slot annular surface 304 and the recirculation passage 116 open to the inlet bore 102, with the inlet collar 110 completely removed from the housing 100. The second cut 312 that removed the cylindrical layer of material 314 leaves a cylindrical cavity 402 that extends concentrically along the centerline 122 of the inlet bore 102. The cylindrical cavity 402 can optionally be formed by a cutter that is inserted through an opening of the inlet bore 102. Thus, the cavity 402 can extend from an edge 404 of the housing to a peripherally extending annular surface 406. The surface 406 may advantageously be disposed around, or at least close to, the first recirculation slot annular surface 304 that partially defined the recirculation slot 302 in the housing 100 as previously described.

Figure 5:
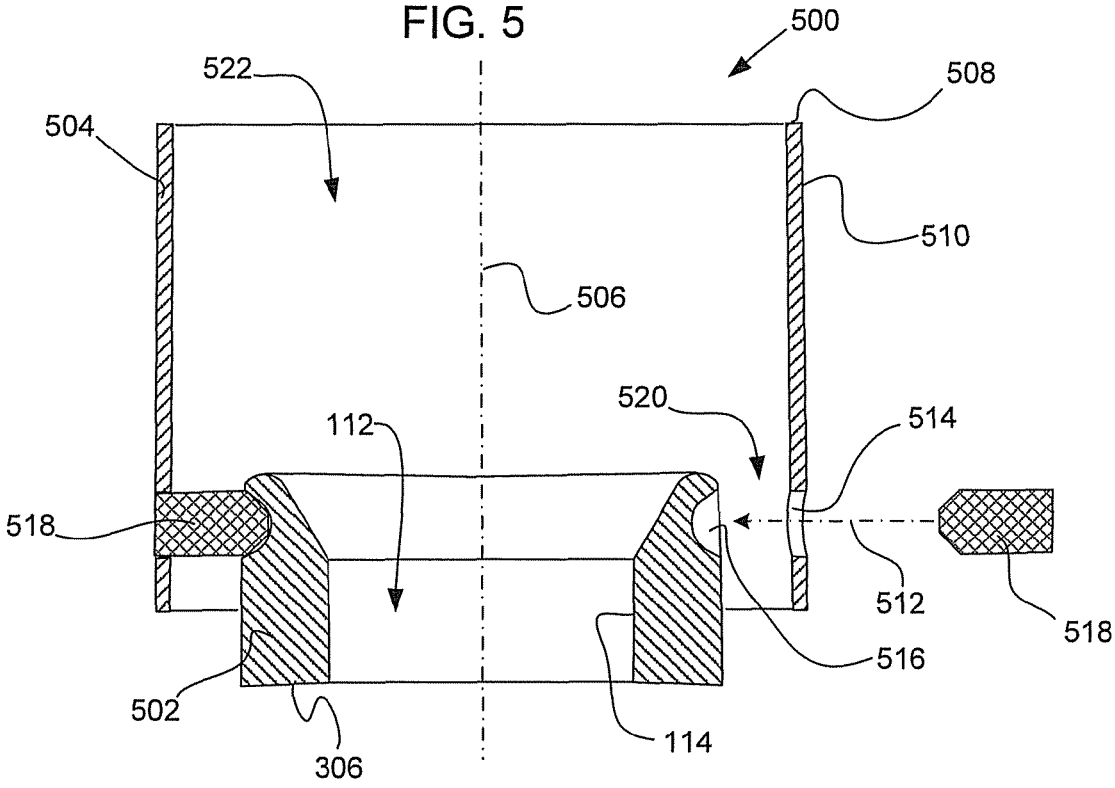
FIG. 5 is a cross-section view of an inlet assembly as described herein.

A cross-section view of an inlet assembly 500 that includes an inlet collar 502 assembled into a cylindrical liner 504 during a subsequent operation in the rebuilding process is shown in FIG. 5. The inlet collar 502 may be the portion of the housing 110 that was removed with the first cut operation 308 as previously described, or may alternatively be a replacement or a new component. In the case when the inlet collar 502 is the inlet collar 110 removed from the compressor housing 100 (or an equivalent thereof), an optional cleaning operation to remove any remaining structure from the posts 118 left thereon may precede assembly of the collar 110 into the cylindrical liner 504. In the illustration of FIG. 5, like reference numerals denote similar features with respect to the collar 110 for the sake of clarity.

The inlet collar 502 is initially placed concentrically along a centerline 506 of the liner 504, at an axial position with respect to an edge 508 of the liner 504. Placement of the collar 502 may be accomplished by use of a fixture (not shown) that is configured to accommodate the two components in a proper positional relationship. The liner 504 may define a continuous cylindrical outer surface 510, or may alternatively be comprised of numerous segments that may or may not be connected to each other (not shown), but that extend entirely around the collar 502. In the embodiment shown, the liner 504 is a continuous piece that can either be formed out of a pipe-shaped stock material, or alternatively formed from a strip of material that is wrapped around a circular mandrel (not shown).

After concentrically and axially placing the collar 502 with respect to the liner 504, a plurality of holes or openings 512 may be drilled or otherwise formed between the two components (as shown, along the dot-dash-dotted line). Each opening 512 may extend radially toward and into the collar 502 by passing clear through the liner 504. The number and location of the openings 512 can advantageously be made to match any desired configuration that accommodates a plurality of posts (not shown). For example, the openings 512 may be formed to match the configuration of the posts 218 and their relative orientation and positioning with respect to each other and with respect to the housing 200 as shown in FIG. 2, or any other suitable configuration. After each opening 512 has been formed, a radially extending opening 514 that extends through the liner 504 is defined in the liner 504, and a radially extending hole 516 is defined in the collar 502. Each radially extending hole 516 in the collar 502 is advantageously aligned with a respective radial opening 514 in the liner 504.

In a subsequent operation, the collar 502 may be connected to the liner 504 with a plurality of dowels or posts 518. Each of the plurality of posts 518 can be inserted into each of the openings 512 and connected to the collar 502 and/or the liner 504 with, for example, a welding, press-fitting, or adhesive operation. More specifically, each post 518 may be inserted through each radial opening 514 and into a respective radial hole 516, such that each post 518 extends through an annular opening 520 that may be defined between the collar 502 and the liner 504. The relative position and orientation of the posts 518 following their installation in the assembly 500 may advantageously match the position and orientation of the posts 218 shown in FIG. 2. Moreover, the flexibility of forming the openings 512 in any desired location is advantageous inasmuch as any number of posts 518 can be arranged around the collar 502 in any desired configuration. The finished assembly 500 defines a central opening 522 that fluidly communicates with the inlet port 112 of the collar 502, the inducer diameter 114, and the annular opening 520.

Figure 6:
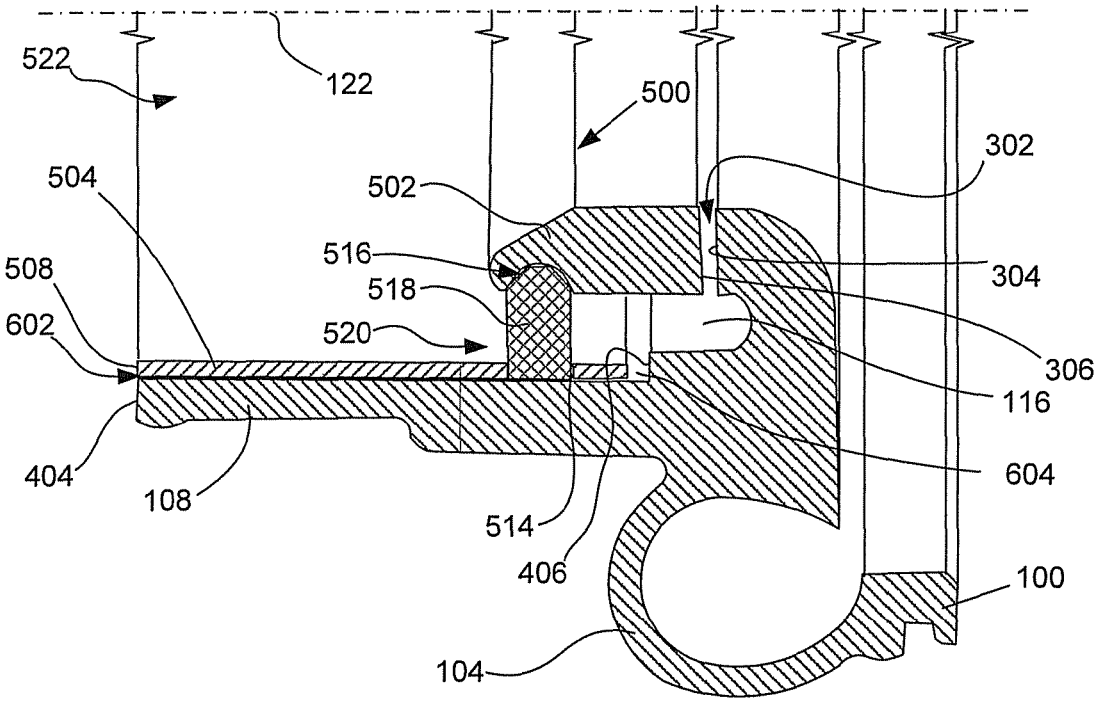
FIG. 6 is a cross-section view of a reworked compressor-housing in accordance with the disclosure.

A partial cross-section view of the assembly 500, installed into the modified housing 100 of FIG. 4, is shown in FIG. 6. As can be appreciated, the outer surface 510 of the liner 504 can advantageously be configured to fit within the cylindrical cavity 402 of the housing 100. In one alternative embodiment, the liner 504 may be arranged and constructed to provide a press-fit clearance with the cylindrical cavity 402 such that a press-fit operation may operate to insert and secure the assembly 500 within the housing 100. Alternatively, a clearance fit may be configured to allow for easy insertion of the assembly 500 into the cylindrical cavity 402, for example, by hand, followed by a welding operation or any other suitable operation, for example, an operation that adds an adhesive between the two components that will act to bond the two components together. In yet another alternate embodiment, a thermal difference may be introduced that thermally expands the housing 100 and/or thermally contracts the assembly 500, for example, by heating the housing 100 and freezing the assembly 500, to yield a clearance fit during installation of the assembly 500 within the housing 100, which clearance fit transforms into an interference fit when all components return to room temperature. An operation that bonds the two components can typically be performed along an interface 602 defined between the outer surface 510 of the liner 504 and the inner surface of the cylindrical cavity 402.

When the assembly 500 is installed in the cylindrical cavity 402 of the modified housing 100, the liner 504 extends concentrically along the centerline 122 of the inlet bore 102 such that the centerline 506 of the assembly 500 lies along the centerline 122 of the inlet bore 102. Moreover, the assembly 500 can be inserted into the housing 100 to leave a gap that extends axially along the centerline 122 between the first recirculation slot annular surface 304 and the second recirculation slot annular surface 306 that, as before, can redefine the recirculation slot 302. The annular opening 520 is aligned with and helps re-define the recirculation passage 116. An optional gap 604 may remain between the liner 504 and the peripherally extending annular surface 406. The gap 604 has been found not to have any measurable effect on the performance of the compressor housing 100, but can optionally be used to accommodate a tool (not shown) that is inserted through the inlet bore 102 to permit minor adjustments to the axial position of the assembly 500 within the housing 100.

Figure 7:
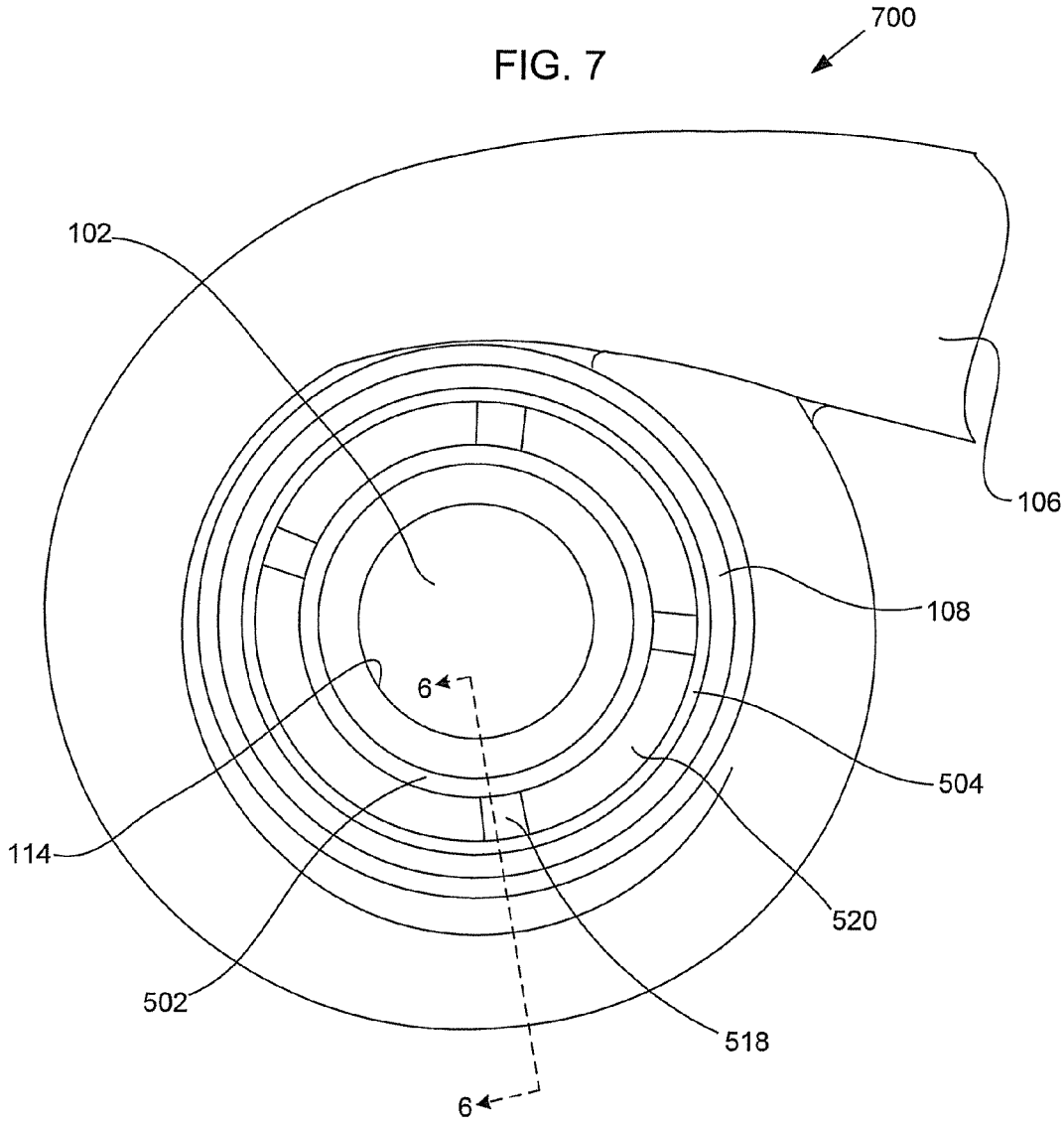
FIG. 7 is an outline view of the reworked compressor shown in cross-section in FIG. 6.

An outline view of a re-worked compressor housing 700 is shown in FIG. 7. The housing 700 is a view of the housing shown in cross-section in FIG. 6, and advantageously includes the modified housing 100 with the assembly 500 installed therein. As can be appreciated, the finished compressor-housing 700 can function in a fashion similar to the updated housing 200. Alternatively, the housing 700 can be configured to emulate any other desired housing arrangement by use of the remanufacturing process disclosed herein. In the example shown, the posts 518 of the assembly 500 can advantageously function to reduce or eliminate the undesired performance characteristics of the original housing 100, without the necessity of replacing the entire housing 100 with a new one. As can be appreciated, the posts 518 in the embodiment shown are advantageously captured between the inlet collar 502 and the housing 700 to avoid possible dislodgment thereof that may cause damage to the compressor during operation.

INDUSTRIAL APPLICABILITY

The industrial applicability of the process and apparatus used when rebuilding a compressor-housing described herein will be readily appreciated from the foregoing discussion. As described, a compressor housing having a first plurality of posts connecting an inlet collar to the housing can advantageously be reworked to include a second plurality of posts that are arranged in a different configuration. The process of reworking existing components is superior to the replacement of obsolete components with new components inasmuch as the cost associated with scrapping the obsolete components is avoided.

The present disclosure is applicable to reconditioning of used turbocharger cores that are returned to a manufacturer for updating, rebuilding, reconditioning, or replacement. There are a great number of older models of these turbochargers presently in circulation, so the ability to retrofit or rework them into turbochargers having performance enhancements consistent with later models is advantageous and cost-effective. As can be appreciated, the retrofit process described herein may be carried out by use of many alternative procedures or operations. One possible and representative procedure is outlined below for the purpose of illustration by way of example.

Figure 8:
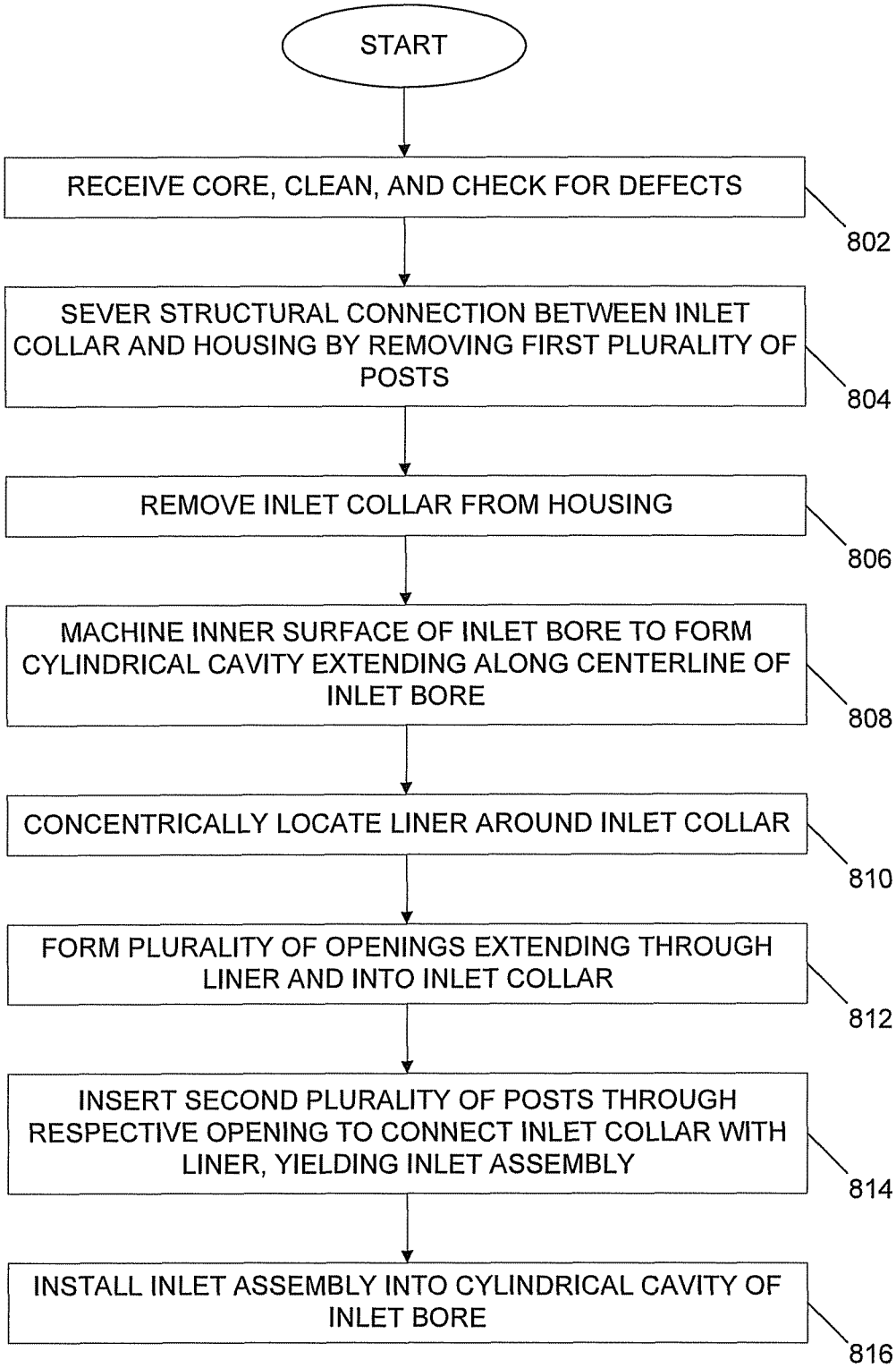
FIG. 8 is a flowchart for a method of reworking a compressor-housing in accordance with the disclosure.

A flowchart for a process or reworking a compressor-housing is shown in FIG. 8. A compressor housing received as part of a returned turbocharger core is cleaned and checked for defects at block 802. Checking the compressor housing for defects may include various known processes for diagnosing structural or dimensional flaws in the returned compressor housing. After the housing has been checked and cleaned, the housing undergoes a first machining process that removes a first plurality of posts to sever a structural connection between an inlet collar and rest of the housing at block 804. The inlet collar is removed or extracted from within an inlet bore of the housing at block 806. Subsequently, an inner surface of the inlet bore can optionally be milled or otherwise machined to form a cylindrical cavity at block 808. The cylindrical cavity may extend along a centerline of the inlet bore. This cleaning process can advantageously remove any remaining structure left over by the posts that were cut, and in some embodiments, act to enlarge an inner diameter of the inlet bore. In the meantime, a component resembling the inlet collar that was removed from the housing, or alternatively the removed collar itself or an equivalent, is positioned in a fixture concentrically within a cylindrical liner at block 810. In the case when the removed collar or an equivalent is used, a machining process to remove any remaining structure of the severed posts may be required before the collar can be placed within the cylindrical liner. In addition, the cylindrical liner may be made of a pipe segment, or may alternatively be made of a strip of metal that has been formed to a cylindrical shape, as described, or any other suitable method.

While the inlet collar is disposed within the liner, a plurality of holes may be drilled or otherwise formed in a radial direction at block 812. The plurality of holes may be drilled inwardly through the liner and into a portion of the collar, such that an opening in the liner is aligned with a respective hole in the collar. One or more posts, or in this example dowels, may be inserted through each opening in the liner and into each respective hole in the collar at block 814. These posts operate to rigidly attach the collar within the liner, and may be welded or otherwise rigidly connected or adhered to each of the liner and/or the collar to form an inlet assembly. The inlet assembly can then be inserted into the cylindrical cavity of the housing at block 816 to form a finished compressor assembly that has improved inlet port post geometry.

As can be appreciated, the processes and apparatus described herein are exemplary and should not be construed as limiting. The rebuilding or reconditioning methodology disclosed can advantageously be used when changing the number and/or location of posts within a recirculation passage surrounding an inlet of a compressor, but can also be used when changing the spacing and/or orientation of posts. Moreover, the disclosed methodologies can be used to repair damaged inlet collars of compressors of any inlet post configuration. Compressor inlet collars can become damaged in cases where a foreign object was allowed to enter into the compressor inlet during operation, for instance a loose bolt, nut, and so forth, or in cases where the compressor wheel experiences a failure mode that structurally affects the inlet collar of the compressor in an undesirable fashion.

It will be appreciated that the foregoing description provides examples of the disclosed system and technique. However, it is contemplated that other implementations of the disclosure may differ in detail from the foregoing examples. All references to the invention or examples thereof are intended to reference the particular example being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated.

All methods described herein can be performed in any suitable order unless otherwise indicated herein or otherwise clearly contradicted by context. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A method for remanufacturing a symmetrical post inlet configuration into a non-symmetrical inlet post configuration in a cast compressor housing, the compressor housing defining an inlet bore, the compressor housing including an integrally cast first inlet collar connected to the housing with a first plurality of integrally cast posts disposed radially around the inlet collar between the inlet collar and the inlet bore, the inlet collar disposed entirely within the inlet bore and forming an inducer bore of the compressor housing, the method comprising:

removing the first plurality of integrally cast posts that are symmetrically disposed around the inlet collar such that the inlet collar is then detachable from the compressor housing;

removing the inlet collar from the housing;

connecting a second inlet collar to a cylindrical liner by radially inserting a second plurality of posts through the cylindrical liner and into the second inlet collar in a direction radially inward toward a centerline of cylindrical liner, the second plurality of posts being disposed asymmetrically around the second inlet collar, the second inlet collar defining an inducer bore that is substantially equal to the inducer bore of the first inlet collar;

performing a second cut to the housing to remove a cylindrical layer of material and form a cylindrical cavity around the inlet bore;

inserting the cylindrical liner containing the second inlet collar into the cylindrical cavity of the inlet bore of the housing;

connecting the cylindrical liner to the housing such that the second inlet collar forms the inducer bore of the compressor housing.

2. The method of claim 1, wherein performing the second cut includes machining an inner surface of the inlet bore to form the cylindrical cavity, the cylindrical cavity extending concentrically along the centerline of the inlet bore, wherein the cylindrical liner containing the second inlet collar is inserted into the cylindrical cavity of the inlet bore.

3. The method of claim 2, further comprising at least one of press-fitting and bonding the cylindrical liner containing the second inlet collar into the cylindrical cavity of the inlet bore.

4. The method of claim 2, wherein a position of the inner surface of the inlet bore is machined with respect to at least one datum target formed on the housing.

5. The method of claim 1, further including concentrically locating the cylindrical liner around the second inlet collar, the cylindrical liner disposed at a radial distance around the second inlet collar, the cylindrical liner extending around at least a portion of a periphery of the second inlet collar.

6. The method of claim 1, further comprising:

redefining a recirculation slot between a first recirculation slot annular surface, the first recirculation slot annular surface defined on the housing, and a second recirculation slot annular surface, the second recirculation slot annular surface defined on the second inlet collar, when the cylindrical liner containing the second inlet collar is inserted into the inlet bore of the housing, the operation of inserting accomplished by maintaining a gap between the first recirculation slot annular surface and the second recirculation slot annular surface.

7. The method of claim 1, further comprising welding each of the second plurality of posts to at least one of the cylindrical liner and the second inlet collar.

8. The method of claim 1, further comprising press-fitting each of the second plurality of posts into at least one of the cylindrical liner and the second inlet collar.

9. The method of claim 1, further comprising applying an adhesive between each of the second plurality of posts and at least one of the cylindrical liner and the second inlet collar.

10. A method of reworking a cast compressor housing having an inlet bore, the compressor housing having a first plurality of posts integrally cast therewith and arranged in a symmetrical configuration around an inlet collar that is integrally cast with the first plurality of posts and the compressor housing, the inlet collar defining an inducer bore therewithin and disposed entirely within the inlet bore, the method comprising:

performing a first cut that severs the first plurality of integrally cast posts connecting the inlet collar with the housing of the compressor such that support is removed between the inlet collar and the housing;

removing the inlet collar from the housing;

performing a second cut to the housing, the second cut extending peripherally around an inner portion of the inlet bore such that a cylindrical layer of material is removed from the housing to form a cylindrical cavity around the inlet bore;

assembling the inlet collar previously removed from the cast compressor housing within a liner to yield an inlet assembly, the assembling operation including:

cleaning material remaining from the first plurality of integrally cast posts from the inlet collar, locating the inlet collar concentrically within the liner, forming a plurality of openings that extend radially through the liner and into the inlet collar, and inserting a second plurality of posts, one each, through each of the plurality of openings, such that the second plurality of posts is arranged in a non-symmetrical configuration around the inlet collar;

inserting the inlet assembly into the cylindrical cavity of the inlet bore.

11. The method of claim 10, further comprising welding each of the second plurality of posts to at least one of the liner and the inlet collar.

12. The method of claim 10, wherein inserting the inlet assembly into the cylindrical cavity of the inlet bore is accomplished by pressing the inlet assembly into the cylindrical cavity in a press-fitting operation.

13. The method of claim 10, further comprising aligning the inlet collar with the liner on a fixture.

14. The method of claim 10, further comprising locating a cutter with respect to at least one target datum, the at least one target datum formed on the housing, and using the cutter to perform the second cut.

15. A method of reworking a compressor housing having an inlet bore, the compressor housing being integrally formed with three original posts arranged in a symmetrical configuration around an integrally formed inlet collar, the inlet collar disposed within the inlet bore, the method comprising:

cutting the three original posts to free the inlet collar from the housing;

removing the inlet collar from the housing;

performing a second cut to the housing, the second cut extending peripherally around an inner portion of the inlet bore such that a cylindrical layer of material is removed from the housing to form an enlarged bore along a portion of the inlet bore;

assembling a second inlet collar within a liner to yield an inlet assembly, the assembling operation including:

locating the second inlet collar concentrically within the liner, forming a plurality of four openings that extend radially through the liner and into the second inlet collar, the four openings extending along a single plane and spaced at asymmetrical angles around the second inlet collar, and inserting a second plurality of posts, one each, through each of the four openings to form four new posts, the four new posts being arranged in a non-symmetrical configuration around the second inlet collar; and inserting the inlet assembly into the enlarged bore of the inlet bore.

16. The method of claim 15, further comprising press-fitting each of the four new posts to the liner.

17. The method of claim 15, wherein inserting the inlet assembly into the enlarged bore of the housing includes press-fitting the liner into the enlarged bore.

18. The method of claim 15, further comprising aligning the second inlet collar with the liner on a fixture.

19. The method of claim 15, further comprising locating a cutter with respect to at least one target datum, the at least one target datum formed on the housing, and using the cutter to perform the second cut.

20. The method of claim 19, further comprising rotationally orienting the inlet assembly, with respect to the at least one target datum, within the enlarged bore.

* * * * *